US011300349B2

(12) United States Patent
Reynolds et al.

(10) Patent No.: US 11,300,349 B2
(45) Date of Patent: Apr. 12, 2022

(54) UPRIGHT APPLIANCE DRAIN JUMPER

(71) Applicant: Electrolux Home Products, Inc., Charlotte, NC (US)

(72) Inventors: Matt Quintin Reynolds, Anderson, SC (US); Yousuf Ali Khan Mayanna, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 214 days.

(21) Appl. No.: 16/585,580

(22) Filed: Sep. 27, 2019

(65) Prior Publication Data

US 2021/0095912 A1 Apr. 1, 2021

(51) Int. Cl.
*F25D 21/14* (2006.01)

(52) U.S. Cl.
CPC ..... *F25D 21/14* (2013.01)

(58) Field of Classification Search
CPC ..... F25D 21/14; F25D 2321/14; F25D 2321/143; F25D 2321/144; F25D 2321/146
See application file for complete search history.

(56) References Cited

U.S. PATENT DOCUMENTS 1,235,304 A 7/1917 Foster
1,504,126 A 10/1923 Lassell
3,696,632 A * 10/1972 Carlin ..... F25D 17/047 62/285
5,499,514 A 3/1996 Ho
5,557,942 A 9/1996 Kim et al.
6,672,094 B1 1/2004 Carden et al.
8,826,944 B1 9/2014 Laine
9,046,301 B2 6/2015 Park et al.
9,212,844 B2 12/2015 Lee et al.
9,863,689 B2 1/2018 Lee et al.
2006/0277934 A1 12/2006 Cho
2010/0269531 A1 10/2010 Samdan et al.
2012/0117998 A1* 5/2012 Yoo ..... F25D 21/14 62/288
2012/0131943 A1* 5/2012 Shin ..... F25D 21/14 62/331

(Continued)

FOREIGN PATENT DOCUMENTS

DE 102010017919 10/2011
EP 0848217 6/1998
FR 2647193 11/1990

(Continued)

*Primary Examiner* — Elizabeth J Martin
(74) *Attorney, Agent, or Firm* — Pearne & Gordon LLP

(57) ABSTRACT

A drain assembly for a refrigeration appliance in communication with an appliance drain. The drain collects condensate from an evaporator behind the rear wall of the cabinet and transfers the condensate to the drain assembly in the machine compartment of the refrigeration appliance. The drain assembly then transfers the condensate to an extension tube easily accessible to an operator. The drain assembly includes an inlet, a main body, and an outlet. The inlet is secured to the appliance drain and the outlet is secured to the extension tube. The main body also comprises a downward slope in between the inlet and the outlet. In one example, a vacuum relief system can equalize a pressure differential between an interior of the main body and an exterior environment.

18 Claims, 8 Drawing Sheets

(56) References Cited

U.S. PATENT DOCUMENTS

| | | | | |
|---|---|---|---|---|
| 2015/0121925 | A1* | 5/2015 | Park | F25D 21/002 62/151 |
| 2017/0045286 | A1 | 2/2017 | Ungor et al. | |

FOREIGN PATENT DOCUMENTS

| | | |
|---|---|---|
| WO | 2007023471 | 3/2007 |
| WO | 2009132940 | 11/2009 |

* cited by examiner

UPRIGHT APPLIANCE DRAIN JUMPER

FIELD OF THE INVENTION

The present application relates generally to an appliance drain of an appliance. More particularly, it relates to an appliance drain jumper assembly for a refrigerating appliance that can connect to an existing appliance drain and transfer drain water to a preferred location within a machine compartment.

BACKGROUND OF THE INVENTION

Conventionally, an appliance drain passes through an appliance cabinet near the rear of a machine compartment. The appliance drain carries water, such as melt water from an automatic defrost evaporator, outside of the chilled compartment. However, this conventional configuration makes it difficult for an operator to access the drain and connect a drain tube to transfer the drain water to a desired location, such as a drain pan under a condenser coil.

It is an objective of the present disclosure to alleviate or overcome one or more difficulties related to the prior art. It has been found that a new drain jumper assembly can be configured to allow an operator to connect a drain tube in an easily accessible location. Specifically, a drain jumper assembly can transfer drain water to a preferred location within the machine compartment. In a further embodiment, the drain jumper can swivel or rotate about the axis of the existing drain to further assist with easier assembly.

BRIEF SUMMARY OF THE INVENTION

In accordance with one aspect, a drain extension assembly for an appliance provides fluid communication between an internal storage compartment and an exterior environment via an appliance drain that collects and transfers liquid condensate from an evaporator. The drain extension assembly comprises a main body with an inlet at one end and an outlet at an opposite end, wherein main body comprises a downward slope extending between the inlet and the outlet. The inlet is configured to be secured to said appliance drain and the outlet is configured to be secured to an extension tube that is configured to discharge said liquid condensate into a drain pan disposed below a condenser.

In accordance with a second aspect, an appliance comprises a cabinet defining a storage compartment, an evaporative cooling system that is configured to reduce a temperature of the storage compartment, and an evaporator, a condenser, and a compressor. The evaporator is positioned within the storage compartment, and the condenser and compressor are positioned within a machine compartment located below and external to the storage compartment. A drain is disposed below the evaporator to collect and transfer liquid condensate from the evaporator, and provides fluid communication between the storage compartment and the machine compartment. A drain extension assembly comprises a main body with an inlet at one end and an outlet at an opposite end. The main body comprises a downward slope extending between the inlet and the outlet, wherein the inlet is secured to the drain at said machine compartment, and the outlet is secured to an extension tube that discharges said liquid condensate into a drain pan disposed below the condenser.

In accordance with a third aspect, a drain extension assembly for an appliance that provides fluid communication between an internal storage compartment and an exterior environment via an appliance drain that collects and transfers liquid condensate from an evaporator, comprises a main body with an inlet at one end and an outlet at an opposite end. The main body comprises a downward slope extending between the inlet and the outlet, wherein the inlet is configured to be secured to said appliance drain and the outlet is configured to be secured to an extension tube that is configured to discharge said liquid condensate into a drain pan disposed below a condenser. A vacuum relief system extends from the main body and provides selective fluid communication between the main body and said exterior environment, wherein a pressure relief valve is configured to automatically equalize a pressure differential between an interior of the main body and said exterior environment.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF PREFERRED EMBODIMENTS

Figure 1:
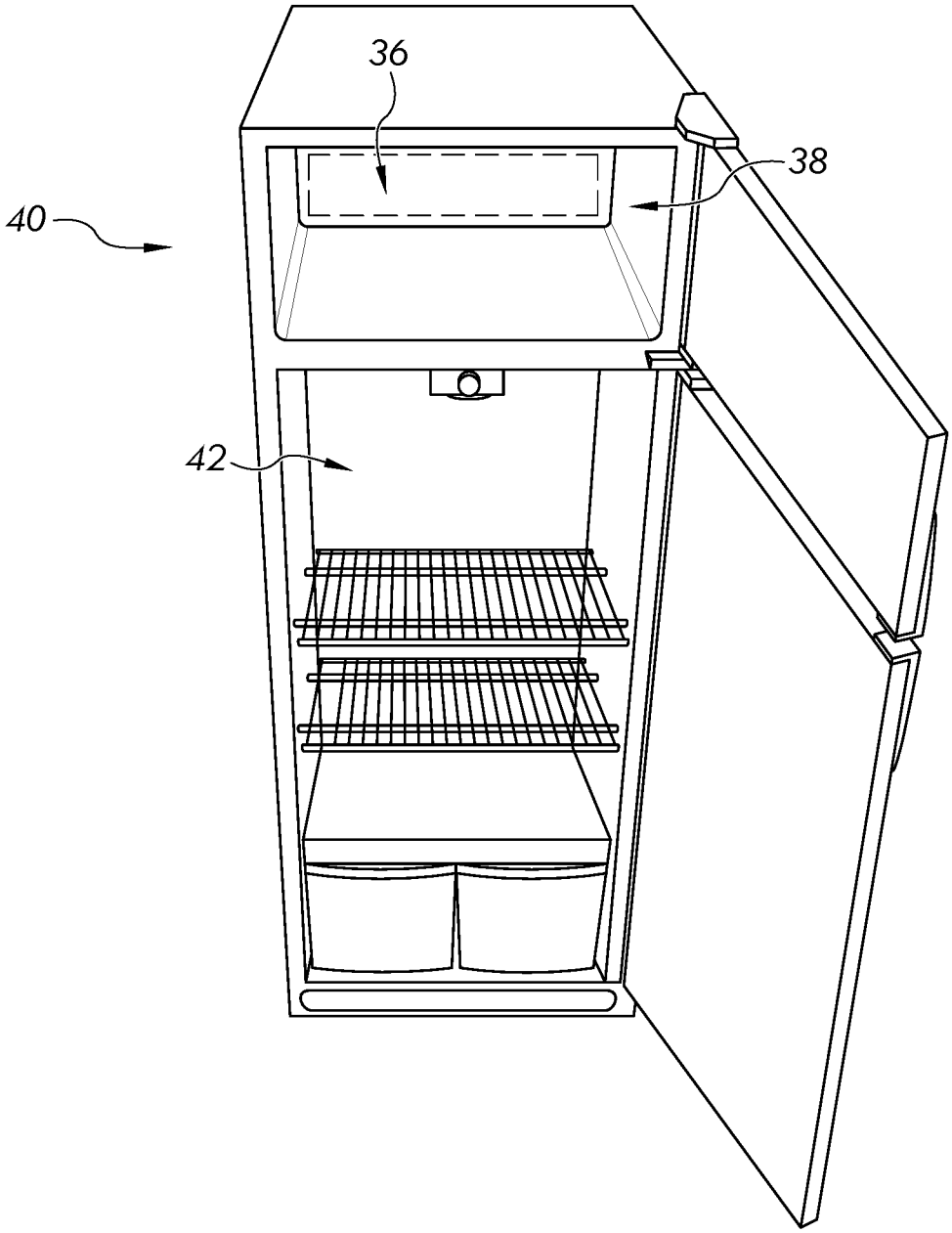
FIG. 1 is a front perspective view of an example top-mount refrigeration appliance.

Example embodiments are described and illustrated in the drawings. These illustrated examples are not intended to be limiting. For example, one or more aspects or features from each embodiment can be combined with or utilized in other embodiments.

Herein, when a range such as 5-25 (or 5 to 25) is given, this means preferably at least 5 and, separately and independently, preferably not more than 25. In an example, such a range defines independently at least 5, and separately and independently, not more than 25.

Referring now to the drawings, FIG. 1 shows a refrigeration appliance in the form of a top-mount refrigerator, indicated generally at 40, having a cabinet that includes a freezer compartment 38 located vertically-above a fresh food compartment 42. Although the detailed description that follows is described with reference to a top-mount refrigerator 40, other refrigeration appliance configurations can be utilized, e.g., a single door upright refrigerator or freezer, a bottom-mount refrigerator (i.e., the freezer is located vertically-below the fresh food compartment), a French-door bottom-mount refrigerator (i.e., a bottom-mount refrigerator that includes adjacent "French" style doors), a side-by-side refrigerator (i.e., the freezer compartment is on one side and the fresh food compartment is on the other side, opposite of the freezer compartment), etc.

Figure 2:
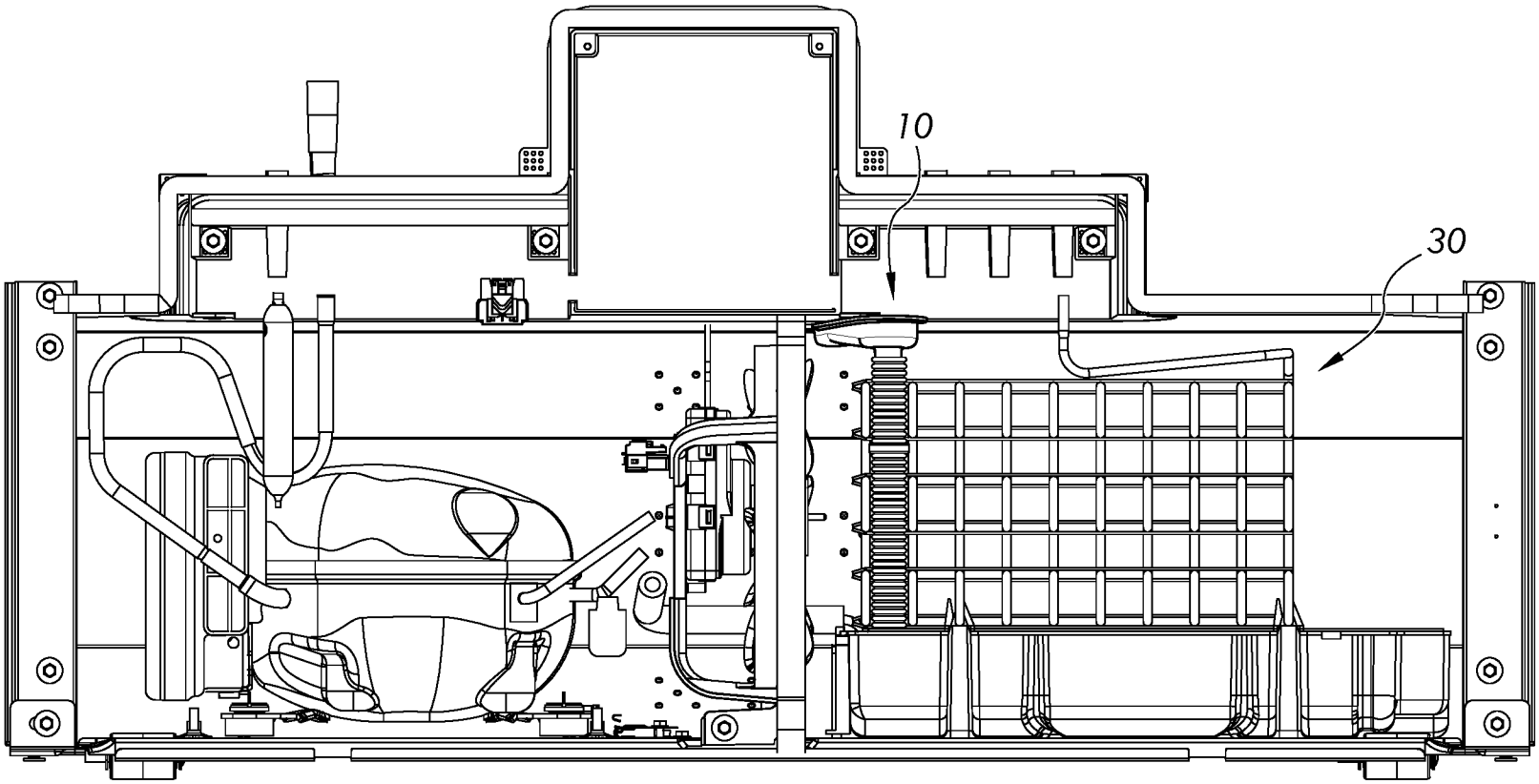
FIG. 2 is a front view of a machine compartment located at a rear of the refrigeration appliance, with an example drain jumper assembly.

The freezer compartment 38 of the appliance 40 is used to freeze and/or maintain articles of food in a frozen condition. For this purpose, the freezer compartment 38 is in thermal communication with a freezer evaporator 36, which is located in the rear of the appliance and in between the cabinet and exterior walls. The evaporator 36 removes thermal energy from the freezer compartment 38 to maintain a temperature of 0° C. or less during operation of the refrigerator 40. The removal of thermal energy from the freezer compartment results in condensation build-up around the evaporator coils (not shown), which can form frost or ice that is periodically removed by a defrost operation. During the defrost operation, an electric heater is operated to raise the temperature of the evaporator coils to melt the frost or ice into water condensate. This condensate drips from the evaporator 36, to a drain 28 (shown in FIG. 4) that is in fluid communication with a machine compartment 30 (shown in FIGS. 2-4). The machine compartment 30 is typically located external to the cooled compartments 38, 42, and contains the operative elements of the evaporative cooling system (e.g., the compressor, the condenser, the condenser fan, etc.). Other evaporators, such as a fresh food evaporator or an ice maker evaporator, may be employed in similar defrost conditions that generate melt water to be removed from the appliance. FIG. 2 is a front view of a machine compartment located at a rear of the refrigeration appliance, with an example drain jumper assembly according to the instant application. The drain jumper assembly 10 transfers the drain water from the drain 28 to a more easily accessible location for an operator, as discussed in more detail below.

Figure 4:
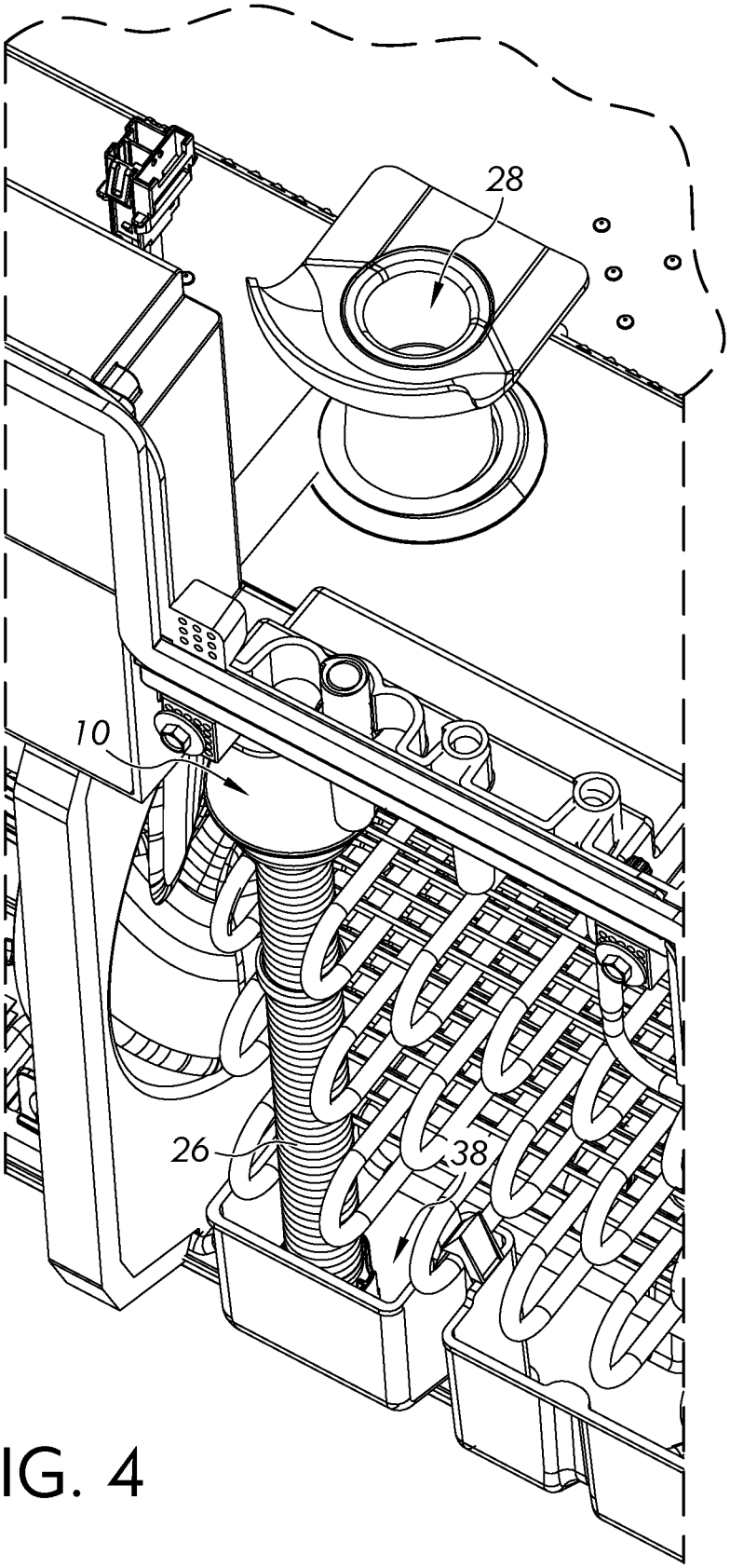
FIG. 4 is a top perspective view of the machine compartment of FIG. 2 with an example appliance drain.

It is to be appreciated that the drain 28 is typically located in the floor or bottom wall of the cooled compartment (any of the freezer compartment or fresh food compartment) at a low point below the evaporator so that the water condensate naturally flows toward the drain 28. The drain 28 is then connected via a suitable length of tubing so that the terminal end of the drain tubing enters the machine compartment. In another example, FIG. 4 is a top perspective view of the machine compartment of FIG. 2 located immediately below an appliance drain 28 (for example, in a single-door freezer, or fresh-food refrigerator). During assembly, the drain 28 is connected to be flush with or recessed into a bottom surface of the cooled compartment so that the water condensate can readily flow therein. Once the cabinet liner is in its final position, an insulating foam is injected in between the liner and the outer walls of the appliance. The foam fills the space between the liner and the machine compartment and surrounds at least a portion of the exterior of the drain tube.

Figure 3:
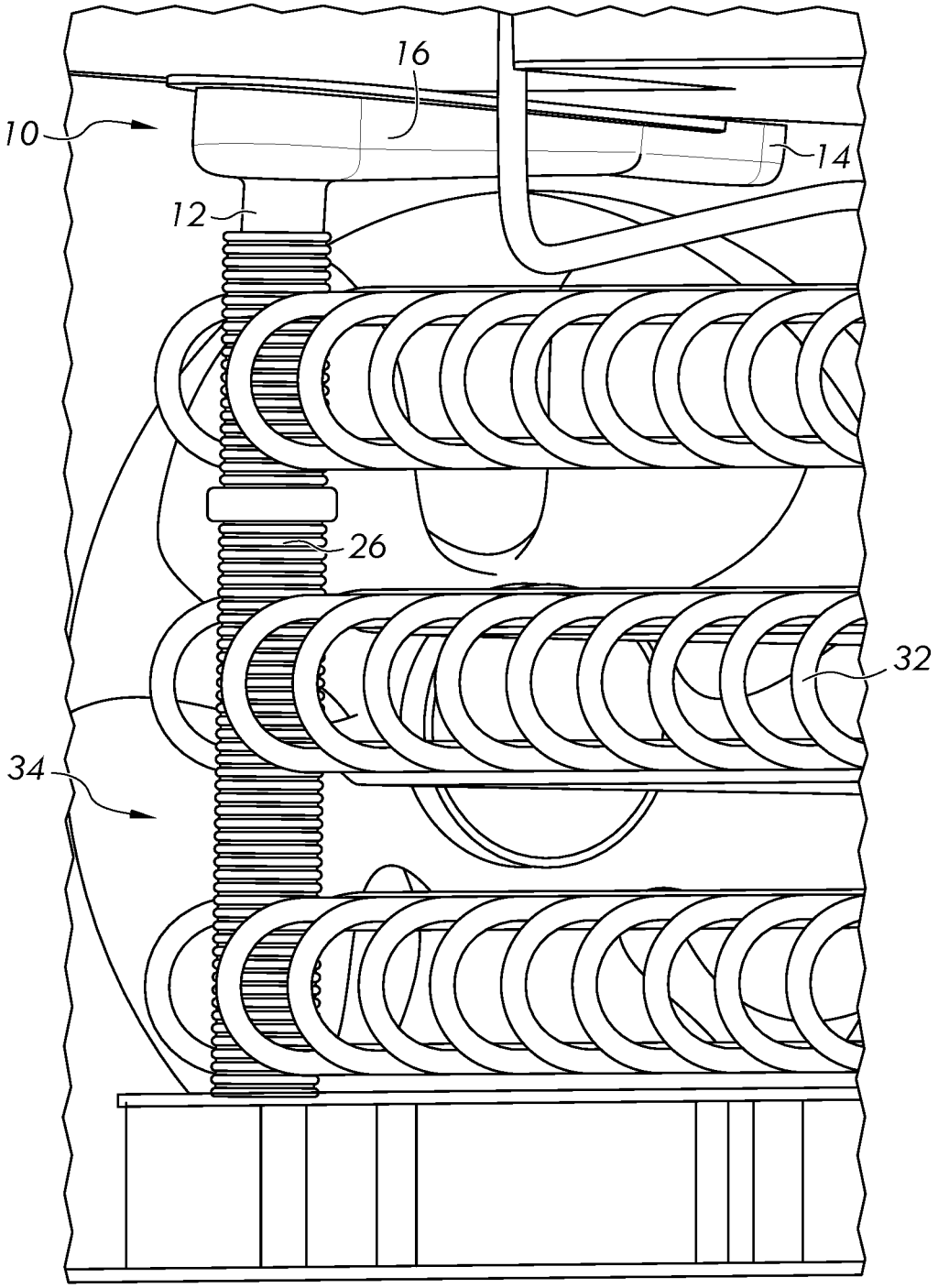
FIG. 3 is a perspective view of the machine compartment of FIG. 2 with an extension tube.

FIG. 3 is a perspective view of the machine compartment of FIG. 2 with an extension tube 26. The drain jumper assembly 10 comprises an inlet 14, a main body 16, and an outlet 12, which together are configured to transfer condensate from the appliance drain 28 (shown in FIG. 4), such as a freezer drain, to a preferred location within the machine compartment.

Figure 5:
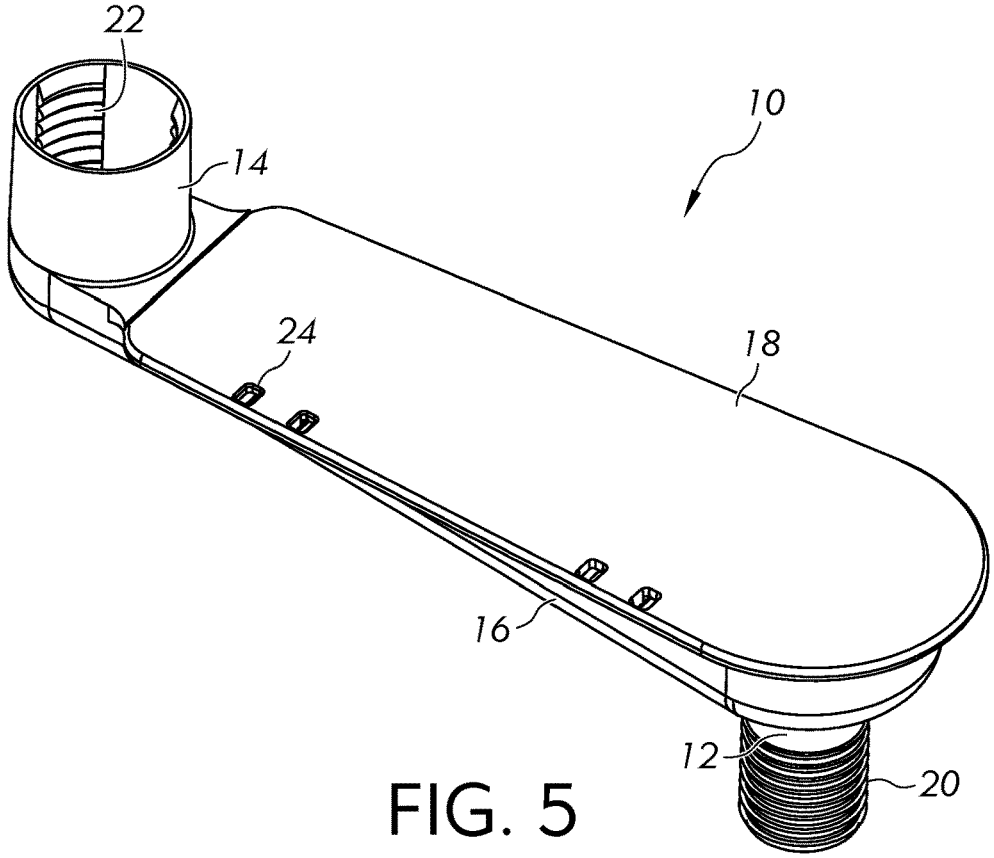
FIG. 5 is a perspective view of the example drain jumper assembly with a lid.

FIG. 5 is a perspective view of a drain jumper assembly 10 with a lid 18. In this embodiment, the drain jumper assembly includes an outlet 12, an inlet 14, a main body portion 16, and a lid 18. The inlet 14 is positioned relatively higher than the outlet 12 so that the main body 16 slopes downward. This configuration allows water to flow by gravity from the inlet 14 to the outlet 12. The main body 16 includes a hollow interior, a downward slope, and a wider portion near the outlet, which all can assist in the flow of water. The lid 18 is used to cover and prevent foreign objects from entering the hollow interior of the main body 16. In one embodiment, the lid 18 is pivotable about a first side of the assembly 10 via at least one hinge. The at least one hinge may be any of the one or combination of the following hinges: a living hinge; a piano hinge; a butterfly hinge; a flush hinge; a barrel hinge; a spring hinge; or any other suitable hinge means. The lid 18 may be connected or attached to the assembly 10. In another embodiment, the lid 18 is secured to a second side of the assembly 10, opposite of the first side, via at least one fastener 24. For example, the lid 18 can be secured to the assembly 10 via one or more fasteners. The at least one fastener may include any one or combination of the following: snaps; clips; hooks; ties; or any other suitable fastening means. The lid 18 can also be removable. In yet another embodiment, the lid 18 can be secured by positioning the assembly 10 adjacent to a top wall of the machine compartment 30. The position of the lid 18 relative to the top wall of the machine compartment 30 is configured to maintain a closed lid position with or without fasteners, and/or to obstruct removal of the lid 18.

Figure 6:
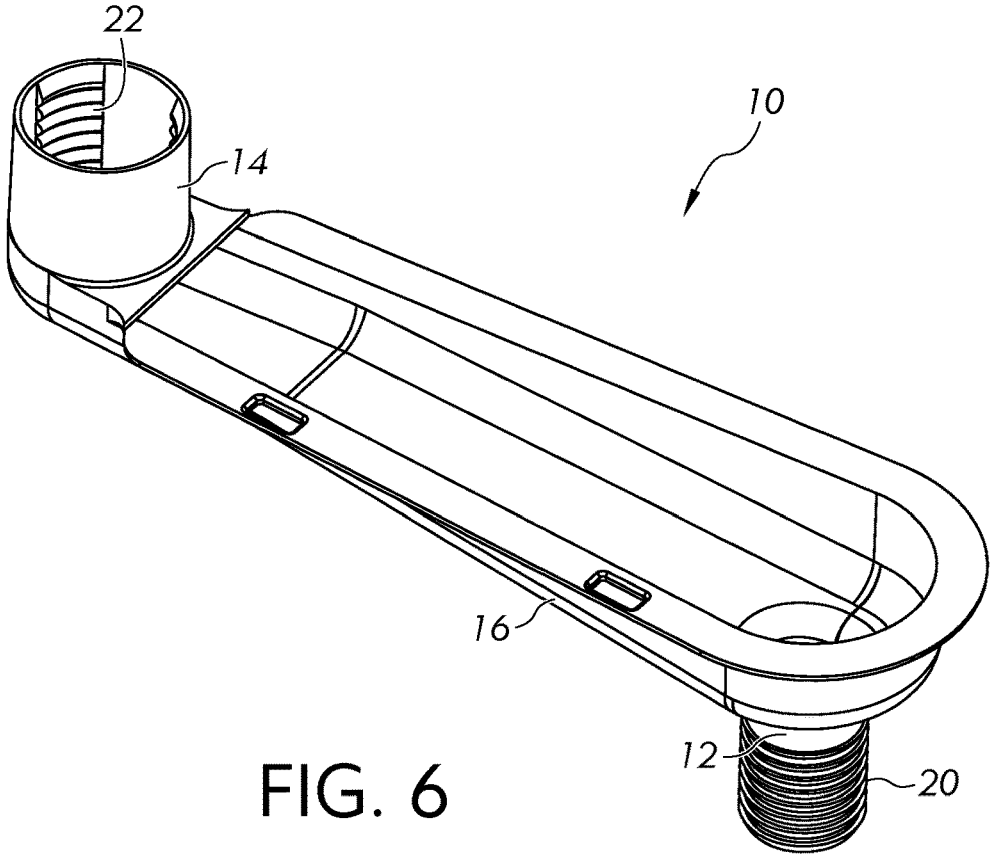
FIG. 6 is a perspective view of another example drain jumper assembly without a lid.

FIG. 6 is a perspective view of a drain jumper assembly 10 without a lid. In this embodiment, the top of the main body 16 can be positioned immediately adjacent to or in abutment with the top of the machine compartment without a separate lid. The position of the main body 16 relative to the top wall of the machine compartment effectively closes off the hollow interior to thereby obviate the need for a separate lid and to cover and prevent foreign objects from entering the main body 16. In yet another embodiment, the distance between the first and second walls of the main body 16 gradually widens from the inlet 14 to the outlet 12. For example, the distance between the first and second walls near the inlet is from 0.5 inches to 1.5 inches, preferably from 0.6 inches to 1.4 inches, more preferably from 0.75 inches to 1.25 inches, and most preferably from 0.9 inches to 1.1 inches. The distance between the first and second walls near the outlet is from 1 inch to 2 inches, preferably from 1.1 inches to 1.9 inches, more preferably from 1.25 inches to 1.75 inches, and most preferably from 1.4 inches to 1.6 inches. In this embodiment, the widening distance between the side walls improves the water flow from the appliance drain 28 to the extension tube 26. In another embodiment, the distance between a first and second side of the lid 18 widens from the inlet 14 to the outlet 12 to correspond with the widening dimensions of the main body 16 and to cover the contents within the main body 16.

As described above, the drain jumper assembly 10 connects between the existing freezer drain 28 and is used to transfer the drain water to a preferred location within the machine compartment. The drain jumper assembly 10 can be connected to each of the appliance drain 28 and the extension tube 26 in a variety of manners, preferably via a removable connection. In one embodiment, the extension tube 26 is secured to the outlet 12 of the drain jumper assembly 10 via an interference fit, which can be airtight. The interference fit can also be tight enough to allow water to travel through without leaking. The outlet 12 can include a first set of ribs 20 (shown in FIGS. 5 and 6) that correspond to a second set of ribs of the extension tube 26. An operator can slide the extension tube 26 over the outlet 12 of the drain jumper assembly 10, which results in a secure connection. The extension tube 26 can also be secured to the outlet 12 via a screw-thread connection, a screw-thread with a rubber gasket connection, a ferrule connection, a compression fitting connection, a coupling connection, or any other suitable connection method. In another embodiment, the inlet 14 of the drain jumper assembly 10 is secured to the appliance drain 28 via interference fit, which can be airtight. The interference fit can also be tight enough to allow water to travel through without leaking. The inlet 14 can include a first set of ribs 22 (shown in FIGS. 5 and 6) that correspond to a second set of ribs of an outlet of the appliance drain 28. The inlet 14 can also be secured to the appliance drain 28 via a screw-threaded connection, a screw-thread with a rubber gasket connection, a ferrule connection, a compression fitting connection, a coupling connection, or any other suitable connection method. The inlet 14 can be secured to the appliance drain 28 and the outlet 12 can be secured to the extension tube 26 by utilizing the same or different connection method.

In yet another embodiment, the drain jumper assembly 10 is configured to swivel or rotate about an axis, such as the central rotational axis, of the appliance drain 28 such that an operator can swivel or rotate the drain jumper assembly 10 to achieve a convenient or easily accessible position for access. For example, the assembly 10 can be rotated to a position where the outlet 12 is located at one of the front or the rear of the machine compartment 30. This embodiment enables an operator to access the drain tube and drain water from a conveniently located position. For example, the extension tube 26 is preferably located at any accessible position for an operator, such as at the front of the machine compartment 30 (i.e., a position readily accessible from the rear of the appliance), or any other accessible location. The extension tube 26 can also be located in front of and/or in between the condenser coils 32 (shown in FIG. 3). In one example, the terminal end of the extension tube 26 can be positioned within a drain pan 44 located below the condenser coils 32 (shown in FIG. 4). The condenser coils 32 radiate latent heat from the evaporative refrigeration process that can help to evaporate the water within the drain pan 44.

Figure 7:
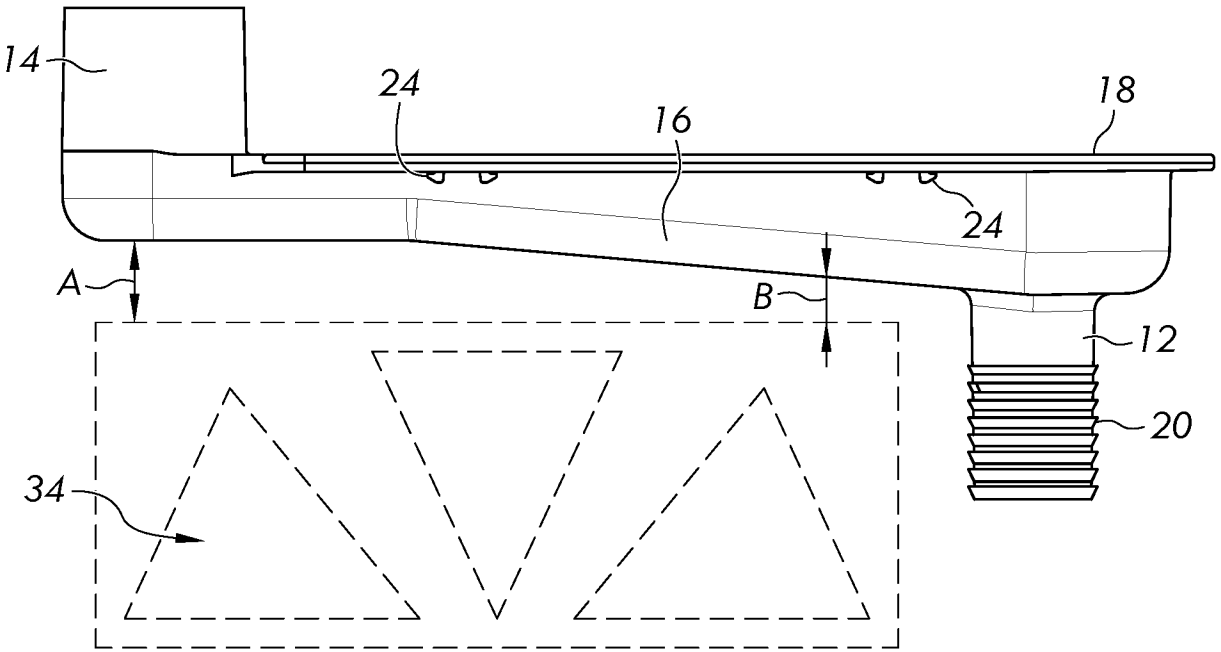
FIG. 7 is a side view of the drain jumper assembly of FIG. 5 positioned near other equipment within the machine compartment.

FIG. 7 is a side view of the drain jumper assembly of FIG. 5 shown next to equipment of the machine compartment. In one embodiment, the bottom wall of the main body 16 includes a substantially flat portion or flat portion near the inlet 14. The bottom of the main body 16 gradually slopes or declines from the flat portion towards the outlet 12 at an angle from about 1° to 20°, preferably from about 2° to 10°, more preferably from about 3° to 7°, and most preferably from about 4° to 6°. This taper enables the water to flow by gravity from the inlet 14 to the outlet 12. In one embodiment, the distance A between the bottom of the main body 16 near the inlet 14, and the fan 34 is greater than the distance B between the bottom of the main body 16 near the outlet 12, and the fan 34. For example, the distance A can be from 0.5 inches to 1.5 inches, preferably from 0.6 inches to 1.4 inches, more preferably from 0.75 inches to 1.25 inches, and most preferably from 0.9 inches to 1.1 inches. The distance B can be from 0.1 inches to 0.9 inches, preferably from 0.25 inches to 0.75 inches, more preferably from 0.3 inches to 0.7 inches, and most preferably from 0.4 inches to 0.6 inches. When a fan, such as the condenser fan, is located adjacent to the main body 16, the tapered bottom surface thereof can interfere or otherwise affect the airflow from the fan 34. The relatively larger distance A at one side of the drain jumper assembly 10 can reduce airflow interference from a fan 34 in the machine compartment 30 to further reduce noise from the machine compartment 30.

Figure 8:
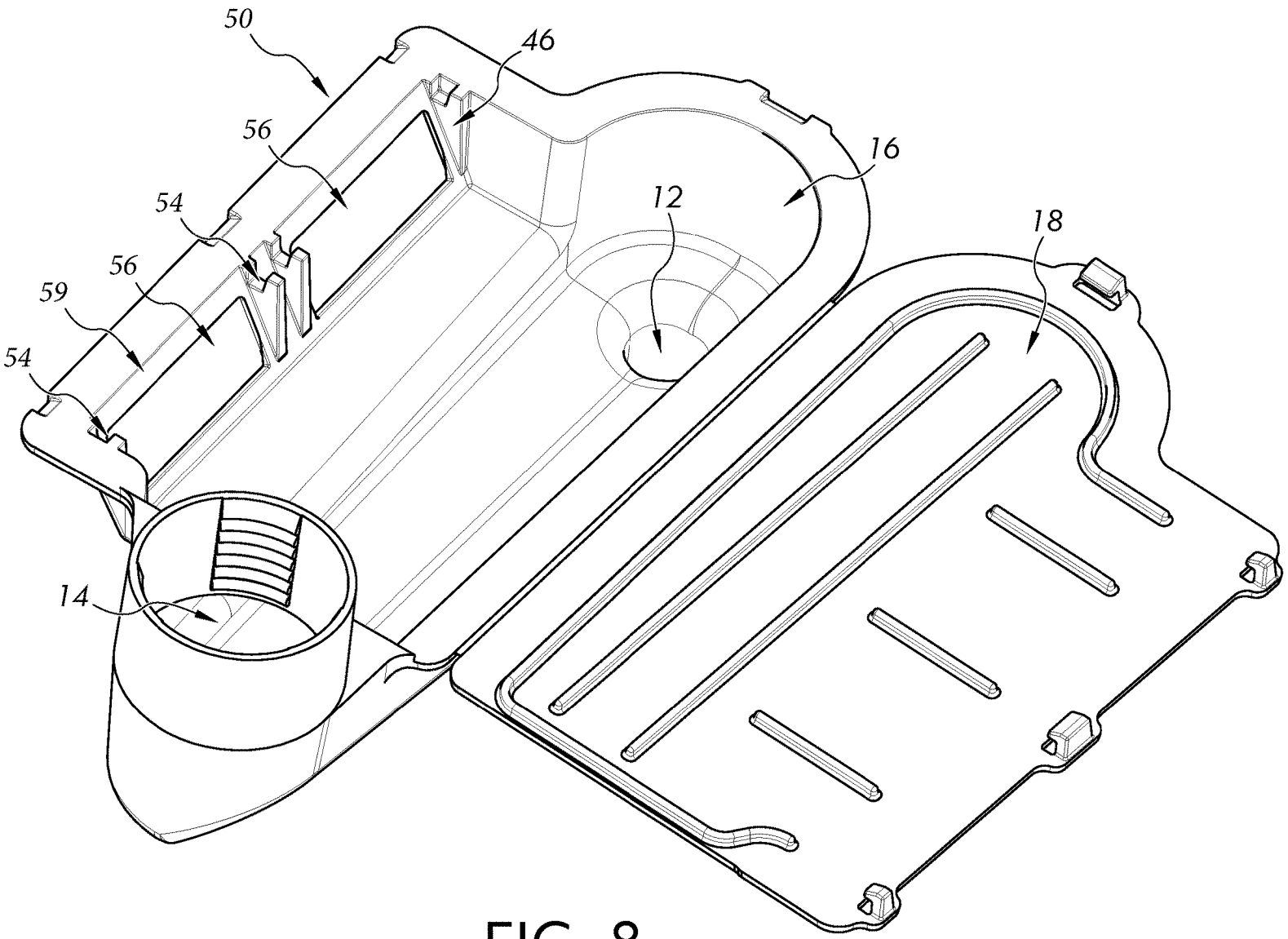
FIG. 8 is a top perspective view of another embodiment of a drain jumper assembly with an example vacuum relief system.
Figure 9:
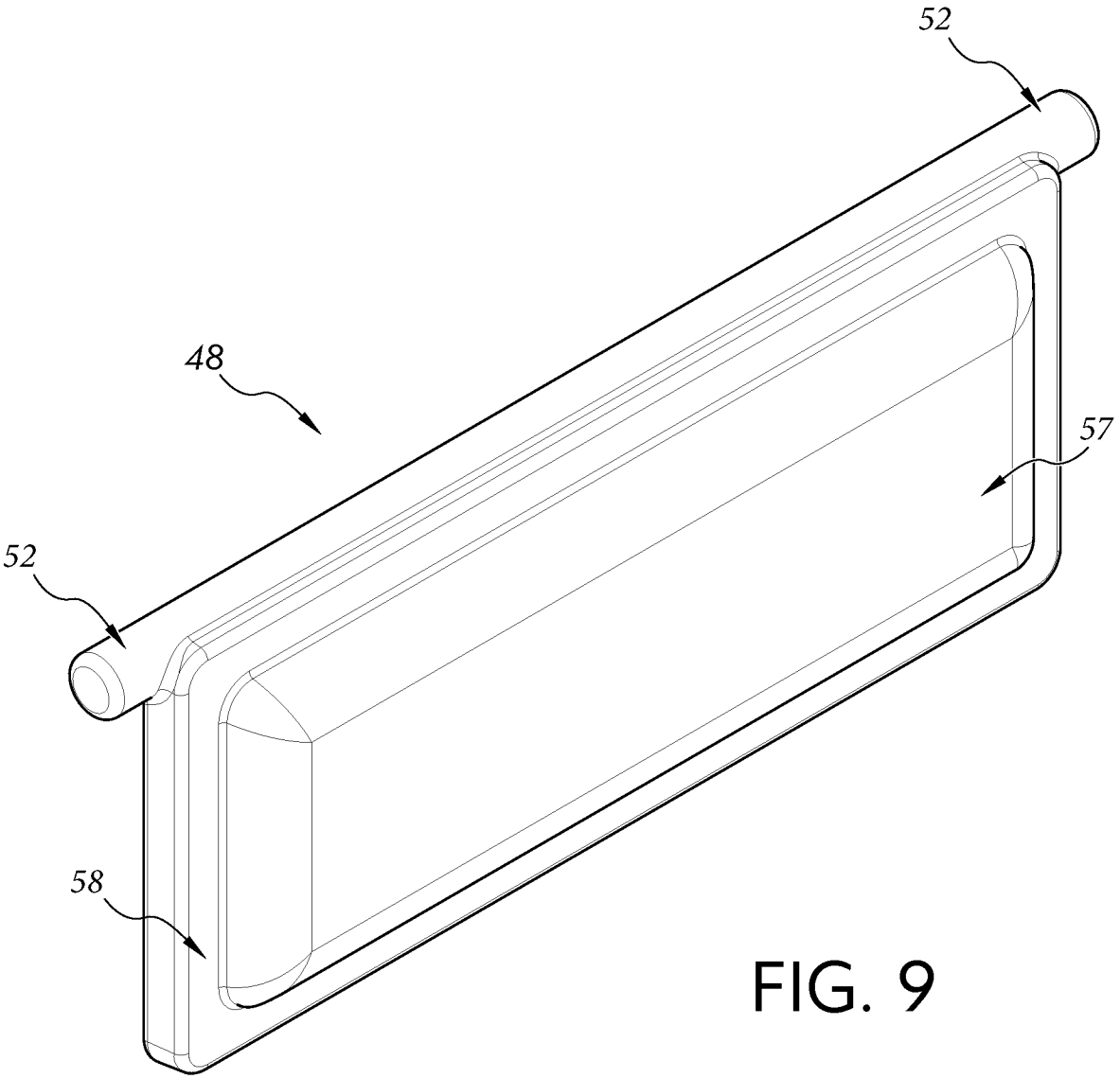
FIG. 9 is a perspective view of a door of the example vacuum relief system for the drain jumper assembly of FIG. 8.

In another embodiment, the drain jumper assembly 10 can include a vacuum relief system 50, as shown in FIGS. 8 and 9. The vacuum relief system 50 includes a pressure relief valve integrally extending from the main body 16 that provides selective fluid communication between the main body and the exterior environment. The vacuum relief system is configured to automatically equalize a pressure differential between an interior of the main body and the exterior environment. The relief valve 46 can be located variously, such as on a side wall of the main body 16. The relief valve 46 includes a side sloped or angled toward the body 16 having at least one moveable relief door 48 configured to be pivotably secured to cover an opening 56 in the side of the relief valve 46. For example, the relief valve 46 can include two or more movable relief doors as shown in FIG. 8, although in other examples only a single door could also be used. As shown in FIG. 9, the relief door 48 can include a raised center portion 57 that is received into the opening 56 when the door is in a closed position. The raised center portion 57 can be surrounded by a flat outer flange 58 that rests upon the interior face 59 of the relief valve 46. The relief door 48 or the interior face 59 can include a seal member (i.e., rubber, silicone, or the like), or the flat outer flange 58 may simply close off the opening 56 via face-to-face contact with the interior face 59.

In one embodiment, the door 48 can be secured via at least one hinge. The at least one hinge may be any of the one or combination of the following hinges: a living hinge; a piano hinge; a butterfly hinge; a flush hinge; a barrel hinge; a spring hinge; or any other suitable hinge means. In yet another embodiment, the door 48 can include two projections 52 that can rest within and rotate relative to corresponding cavities 54 on either side of the relief valve door opening 56. The projections 52 can be cylindrical, or any shape suitable to rotate relative to the cavities 54. The cavities 54 can be rectangular (shown in FIG. 8), cylindrical, or any shape suitable to receive the projections 52. Preferably, the door 48 is configured to open inwardly towards the interior of the main body 16. In this embodiment, the inlet can also include a wider diameter than the inlet 14 without the vacuum relief system 50. For example, the diameter of the inlet 14 can be larger than the diameter of the outlet 12. Further, the bottom of the main body 16 slopes or declines at a greater degree from the flat portion towards the outlet 12 than when the jumper 10 does not include the relief system 50. Additionally, where a vacuum relief system 50 is used, it is preferably located higher than and spaced a distance from the bottom of the main body 16 so that any drain water flowing within the jumper drain does not leak out of the relief door 48.

When an appliance door is opened from a closed position, an undesired vacuum can be created within the appliance, including within the drain jumper assembly 10. Such a vacuum can inhibit the user from re-opening the appliance door. Thus, the vacuum relief system 50 provides a pressure release to the drain jumper assembly 10 when the undesired vacuum is forming. For example, when a vacuum is forming within the appliance and also within the jumper assembly 10, the relief door 48 is automatically pulled open by the force of the forming vacuum pressure. The open door 48, which is in fluid communication with the ambient environment of the machine room, then allows ambient air to enter the jumper 10 and relieve the vacuum pressure. Once the pressure is equalized, the relief door 48 will then return to its normally-closed position. The relief door 48 can be biased towards the normally closed position in various manners. In one example, the relief door 48 can be resiliently biased towards the closed position, such as by a spring or the like. Alternatively, in another example, the relief door 48 can be positioned at an outwardly projecting angle (see FIG. 8) whereby the center of gravity for the relief door 48 is spaced a distance from the rotation axis provided by the cavities 54 so that the door 48 can automatically return to the closed position under the force of gravity once the vacuum within the main body 16 is relieved.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

What is claimed is:

1. A drain extension assembly for an appliance that provides fluid communication between an internal storage compartment and an exterior environment via an appliance drain that collects and transfers liquid condensate from an evaporator, the drain extension assembly comprising:

a main body with an inlet at one end and an outlet at an opposite end, wherein the main body comprises a downward slope extending between the inlet and the outlet, and wherein the downward slope of the main body includes an angle of about 1° to 20°;

wherein the inlet is configured to be secured to said appliance drain and the outlet is configured to be secured to an extension tube that is configured to discharge said liquid condensate into a drain pan disposed below a condenser.

2. The assembly of claim 1, wherein the inlet includes a first set of ribs secured to a second set of ribs of the appliance drain via interference fit.

3. The assembly of claim 1, wherein the outlet includes a first set of ribs secured to a second set of ribs of the extension tube via interference fit.

4. The assembly of claim 1, wherein said angle of the downward slope is of about 2° to 10°.

5. The assembly of claim 1, wherein the assembly is configured to swivel about an axis of the appliance drain.

6. The assembly of claim 1, wherein a distance between a first and second side wall of the main body gradually widens from the inlet to the outlet.

7. The assembly of claim 1, wherein a top surface of the main body abuts a top wall of a machine compartment.

8. The assembly of claim 1, wherein the assembly further comprises a lid configured to cover the main body.

9. The assembly of claim 8, wherein the lid is removable.

10. The assembly of claim 8, wherein the lid is positioned immediately adjacent to a top wall of a machine compartment.

11. The assembly of claim 8, wherein the lid is pivotably connected to at least a first side wall of the main body via at least one hinge.

12. The assembly of claim 11, wherein the lid is secured to a second side wall opposite the first side wall via at least one fastener.

13. The assembly of claim 11, wherein the hinge is a living hinge.

14. An appliance comprising:

a cabinet defining a storage compartment, an evaporative cooling system configured to reduce a temperature of the storage compartment, and comprising an evaporator, a condenser, and a compressor, wherein the evaporator is positioned within the storage compartment, and the condenser and compressor are positioned within a machine compartment located below and external to the storage compartment;

a drain disposed below the evaporator to collect and transfer liquid condensate from the evaporator, the drain providing fluid communication between the storage compartment and the machine compartment; and a drain extension assembly comprising a main body with an inlet at one end and an outlet at an opposite end, wherein the main body comprises a downward slope extending between the inlet and the outlet, and wherein the downward slope of the main body includes an angle of about 1° to 20°, and wherein the inlet is secured to the drain at said machine compartment, and the outlet is secured to an extension tube that discharges said liquid condensate into a drain pan disposed below the condenser.

15. The appliance of claim 14, wherein the inlet of the drain extension assembly includes a first set of ribs secured to a second set of ribs of the drain via interference fit.

16. The appliance of claim 14, wherein the outlet of the drain extension assembly includes a first set of ribs secured to a second set of ribs of the extension tube via interference fit.

17. The appliance of claim 14, wherein the drain extension assembly further comprises a lid positioned immediately adjacent to a top wall of the machine compartment and configured to cover the main body.

18. The appliance of claim 17, wherein the lid is pivotably connected to at least a first side wall of the main body via at least one hinge and secured to a second side wall opposite the first side wall via at least one fastener.

* * * * *